US005693235A

United States Patent [19]

Liu et al.

[11] Patent Number: 5,693,235

[45] Date of Patent: Dec. 2, 1997

[54] METHODS FOR MANUFACTURING COLD CATHODE ARRAYS

[75] Inventors: Nanchou David Liu, Chutung; Jammy Chin-Ming Huang; Jin-Yuh Lu, both of Taipei, all of Taiwan

[73] Assignee: Industrial Technology Research Institute, Hsin-Chu, Taiwan

[21] Appl. No.: 566,648

[22] Filed: Dec. 4, 1995

[51] Int. Cl.[6] ..... H01J 9/02

[52] U.S. Cl. ..... 216/11; 216/39; 216/49; 216/88; 313/310; 445/24; 445/50; 445/51

[58] Field of Search ..... 216/11, 12, 18, 216/41, 49, 39, 88, 89; 313/309, 310; 445/50, 51

[56] References Cited

U.S. PATENT DOCUMENTS

| | | | |
|---|---|---|---|
| 3,998,678 | 12/1976 | Fukase et al. | 216/11 |
| 5,064,396 | 11/1991 | Spindt | 445/50 |
| 5,127,990 | 7/1992 | Pribat et al. | 216/41 |
| 5,176,557 | 1/1993 | Okunuki et al. | 445/50 |
| 5,229,331 | 7/1993 | Doan et al. | 216/11 |
| 5,258,264 | 11/1993 | Mathad et al. | 216/40 |
| 5,312,512 | 5/1994 | Allman et al. | 156/636 |
| 5,319,279 | 6/1994 | Watanabe et al. | 313/309 |
| 5,378,182 | 1/1995 | Liu | 445/24 |
| 5,451,830 | 9/1995 | Huang | 313/309 |
| 5,458,520 | 10/1995 | DeMercurio et al. | 445/24 |
| 5,461,009 | 10/1995 | Huang et al. | 313/309 |
| 5,480,843 | 1/1996 | Park et al. | 445/50 |
| 5,606,215 | 2/1997 | Jaskie et al. | 313/309 |

FOREIGN PATENT DOCUMENTS

| | | | |
|---|---|---|---|
| 700063A1 | 3/1996 | European Pat. Off. . | |
| 720199A1 | 7/1996 | European Pat. Off. . | |
| 08/36966 | 2/1996 | Japan . | |
| 2267176 | 11/1993 | United Kingdom | 445/51 |

OTHER PUBLICATIONS

Lee, et al "A New Approach to Manufaturing Field Emitter Arrays with Submicron Gate Apertures" IVMC '95, Eighth Intl Vacuum Microel.Conf., NY, pp. 14–17, Jul. 1995.

*Primary Examiner*—R. Bruce Breneman
*Assistant Examiner*—Anita Alanko
*Attorney, Agent, or Firm*—George O. Saile; Stephen B. Ackerman

[57] ABSTRACT

A cold cathode emitter structure is described together with two methods for manufacturing it. These methods are cost effective and relatively simple to implement. A key feature is the incorporation of chemical-mechanical polishing into the process. This allows the micro-cones, that serve as cold cathodes, to be easily positioned so that their apexes are located at the correct height relative to the gate lines. A second important feature is that the openings in the gate lines through which the emitted electrons will pass are made to be significantly narrower than in conventional designs.

9 Claims, 6 Drawing Sheets

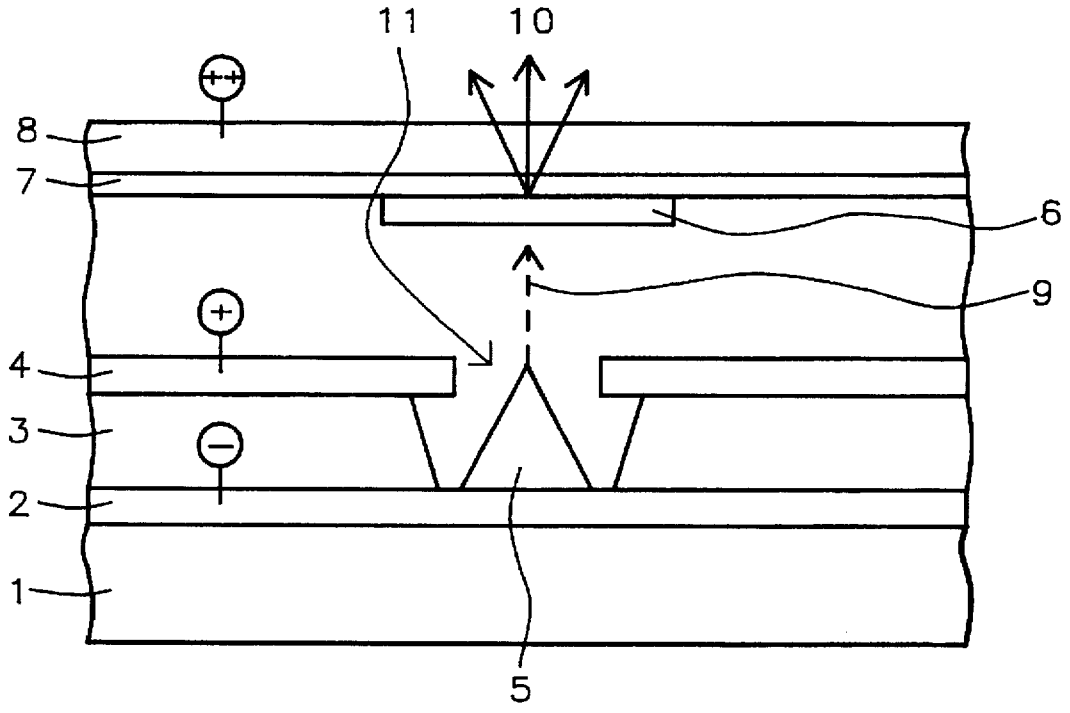
FIG. 1 – Prior Art
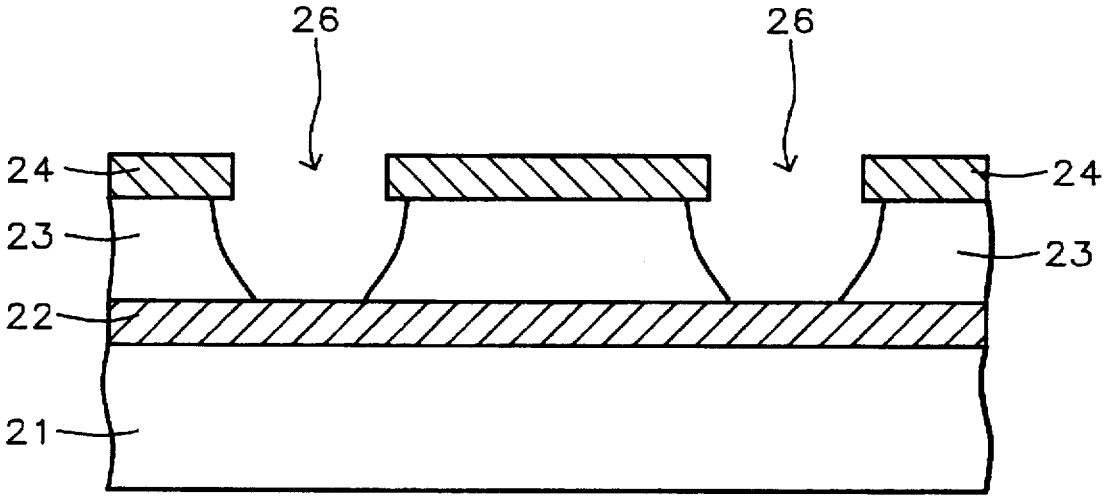
FIG. 2

METHODS FOR MANUFACTURING COLD CATHODE ARRAYS

BACKGROUND OF THE INVENTION (1) Field of the Invention

The invention relates to cold cathode field emission displays and methods for manufacturing them.

(2) Description of the Prior Art

Cold cathode electron emission devices are based on the phenomenon of high field emission wherein electrons can be emitted into a vacuum from a room temperature source if the local electric field at the surface in question is high enough. The creation of such high local electric fields does not necessarily require the application of very high voltage, provided the emitting surface has a sufficiently small radius of curvature.

The advent of semiconductor integrated circuit technology made possible the development and mass production of arrays of cold cathode emitters of this type. In most cases, cold cathode field emission displays comprise an array of very small conical emitters, each of which is connected to a source of negative voltage via a cathode conductor line or column. Another set of conductive lines (called gate lines) is located a short distance above the cathode lines at an angle (usually 90°) to them, intersecting with them at the locations of the conical emitters or microtips, and connected to a source of positive voltage. Both the cathode and the gate line that relate to a particular microtip must be activated before there will be sufficient voltage to cause cold cathode emission.

The electrons that are emitted by the cold cathodes accelerate past openings in the gate lines and strike an electroluminescent panel that is located a short distance from the gate lines. In general, a significant number of microtips serve together as a single pixel for the total display. Note that, even though the local electric field in the immediate vicinity of a microtip is in excess of 1 million volts/cm., the externally applied voltage is only of the order of 100 volts.

In FIG. 1 we show, in schematic cross-section, the basic elements of a typical cold cathode display. A series of metallic lines 2 is formed on the surface of an insulating substrate 1. Said lines are referred to as cathode columns. At regular intervals along the cathode columns, microtips 5 are formed. These are typically cones of height about one micron and base diameter about one micron and comprise molybdenum or silicon, though other materials may also be used. In many embodiments of the prior art, local ballast resistors (not shown here) may be in place between the cones and the cathode columns.

A second series of metallic lines 4 are formed at right angles to the cathode columns, intersecting them at the locations of the microtips. A layer of insulation 3 supports lines 4, which are generally known as gate lines, placing them at the top level of the microtips, that is at the level of the apexes of the cones 5. Openings 11 in the gate lines 4, directly over the microtips, allow streams of electrons 9 to emerge from the tips when sufficient voltage is applied between the gate lines and the cathode columns. Because of the local high fields right at the surface of the microtips, relatively modest voltages, of the order of 100 volts are sufficient.

After emerging through the openings 11 in the gate lines, electrons 9 are further accelerated so that they strike fluorescent screen 6 where they emit visible light rays 10. Screen 6 is part of the top assembly which comprises a glass plate 8 on which has been deposited a transparent conducting layer 7 comprising a material such as indium-tin-oxide. Said top assembly is separated from the cold cathode assembly by spacers (not shown) and the space between these two assemblies is evacuated to provide and maintain a vacuum of the order of $10^{-7}$ torr.

In general, to facilitate manufacturing, openings in the gate lines, such as 11 in FIG. 1, end up having diameters comparable to that of the bases of the micro-cones 5. A smaller diameter for these openings would be advantageous because higher electric field can be generated, resulting in lower turn-on voltages.

The present invention is directed towards improved methods for manufacturing lower assemblies of the general form shown in FIG. 1, including the reduction of gate line hole sizes. Allman (U.S. Pat. No. 5,312,512) is an example of the application of Chem.-Mech. polishing to the processing of silicon integrated circuits but is not obviously applicable to cold cathode devices which are normally manufactured without use of Chem.-Mech. polishing.

SUMMARY OF THE INVENTION

It has been an object of the present invention to provide a cold cathode field emission display wherein the openings in the gate lines, through which the electrons are accelerated, are as small as possible.

Another object of the present invention has been to provide cost effective methods for manufacturing cold cathode field emission displays of the above type.

These objects have been achieved by incorporating chemical-mechanical polishing into the process for manufacturing the field emission displays. This allows the micro-cones that serve as cold cathodes to be easily positioned so that their apexes are located at the correct height relative to the gate lines. Additionally a processing step has been added to enable the internal diameters of the gate line openings to be reduced as needed.

BRIEF DESCRIPTION OF THE DRAWINGS

FIG. 1 shows a typical field emission display of the prior art.

FIGS. 2 through 7 illustrate successive stages in the execution of the method that comprises a first embodiment of the present invention in which openings are etched into an insulating layer, a layer is deposited to reduce the diameters of the openings, microtips and gate lines are formed, and the surface is chemically-mechanically polished to a desired thickness.

DESCRIPTION OF THE PREFERRED EMBODIMENTS

Figure 3:
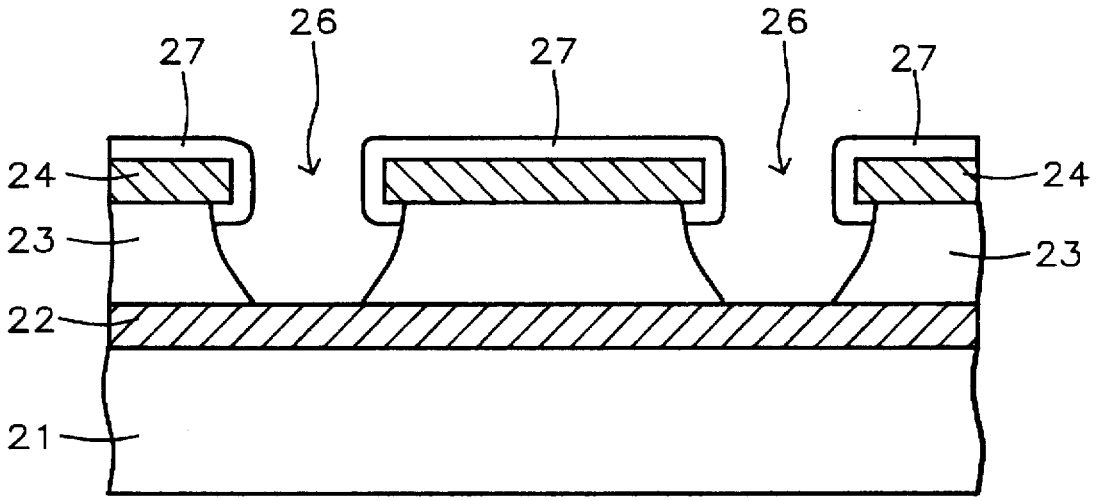

The present invention has been directed towards providing a more efficient method for the manufacture of cold cathode devices than the manufacturing methods in current use. A key feature of the method is the use of chemical-mechanical (Chem.-Mech.) polishing to remove material until the apexes of the micro-cones are at the correct height relative to the cathode columns and gate lines.

While a variety of chem.-mech. polishing methods exist, many of these being applicable to the present invention, our preferred chem.-mech. technique has been to use a slurry of alumina particles in a hydrogen peroxide etchant. Using this technique, we have achieved removal rates for molybdenum between about 300 and 500 Angstroms per minute. While we have preferred to use chem.-mech. polishing, other possibilities for the removal of material, including lapping and grinding, could be used without departing from the spirit and workability of the present invention.

Referring to FIG. 2, we describe a first embodiment of the general method. Cathode columns 22 were formed by depositing a layer of conductive material such as silicon or molybdenum to a thickness between about 3,000 and 5,000 Angstrom units onto insulating substrate 21 and then patterning and etching it. This was followed by depositing insulating layer 23, comprising material such as silicon oxide to a thickness between about 5,000 and 10,000 Angstrom units over said cathode columns. Next, gate lines 24, running orthogonally to cathode columns 22 were formed by depositing a second conductive layer of material 24 such as silicon, molybdenum, tungsten, or tantalum to a thickness between about 3,000 and 5,000 Angstrom units onto insulating layer 23 and then patterning and etching it. This was followed by the etching of openings 26 in layer 24 (from which the gate lines will be formed), further followed by the overetching of layer 23, using the modified gate lines as masks. This last etching step was allowed to proceed until regions, having areas at least as large as that of opening 26, were uncovered on the upper surface of 22. This also caused significant undercutting of openings 26 to occur. At this point in the process, the structure had the appearance shown in schematic cross-section in FIG. 2.

Referring now to FIG. 3, the size of openings 26 in layer 24 is now reduced by isotropically depositing additional conductive layer 27 over all exposed surfaces of layer 24. The preferred method for depositing layer 27 has been electroplating but other methods, such as evaporation could also be used. Typically, layer 27 has comprised silicon, molybdenum, or aluminum to a thickness between about 0.3 and 1 micron, 0.5 microns being typical. This resulted in a reduction of the diameters of openings 26 from about 2 microns to about 1 micron.

Figure 4:
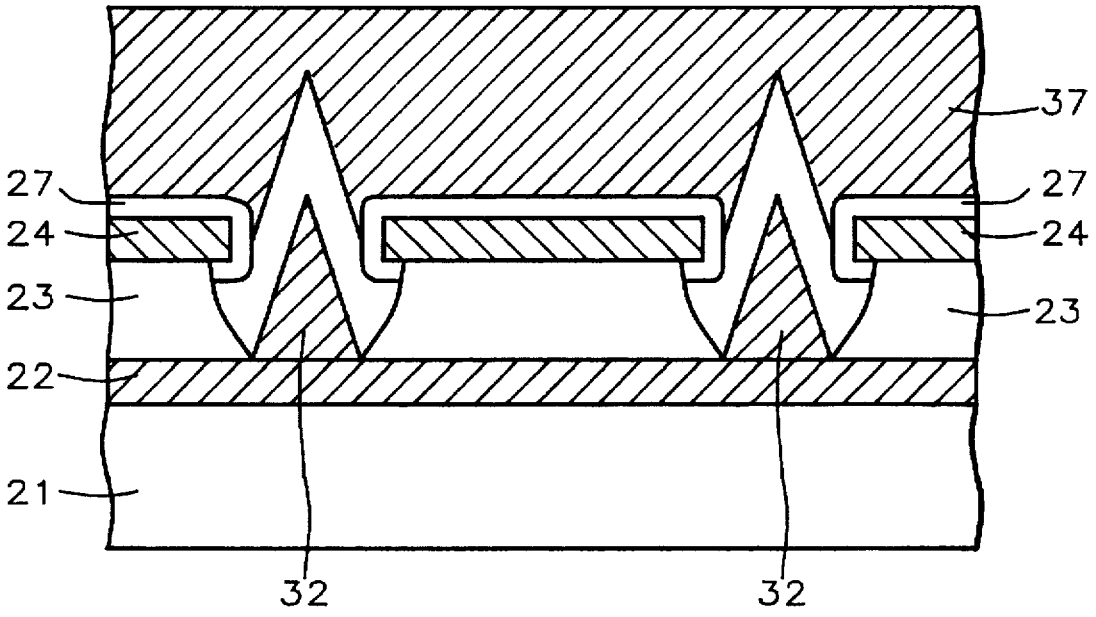

Proceeding now to FIG. 4, under vacuum, material, such as molybdenum or tantalum, was directed at the structure from an extended source (not shown) thereby causing material to arrive from all directions so that small cones 32 formed inside openings 26 in addition to the build-up of layer 37 on the top surface of the structure. Evaporation was terminated when the original shadowing effects of openings 26 ceased to play a role, layer 37 became continuous, and the cones in openings 26 were complete. At this point the thickness of layer 37 was between 1.5 and 2 microns. The deposition conditions for this step were chosen so that the apexes of cones 32 were level with upper surface of layer 27.

Figure 5:
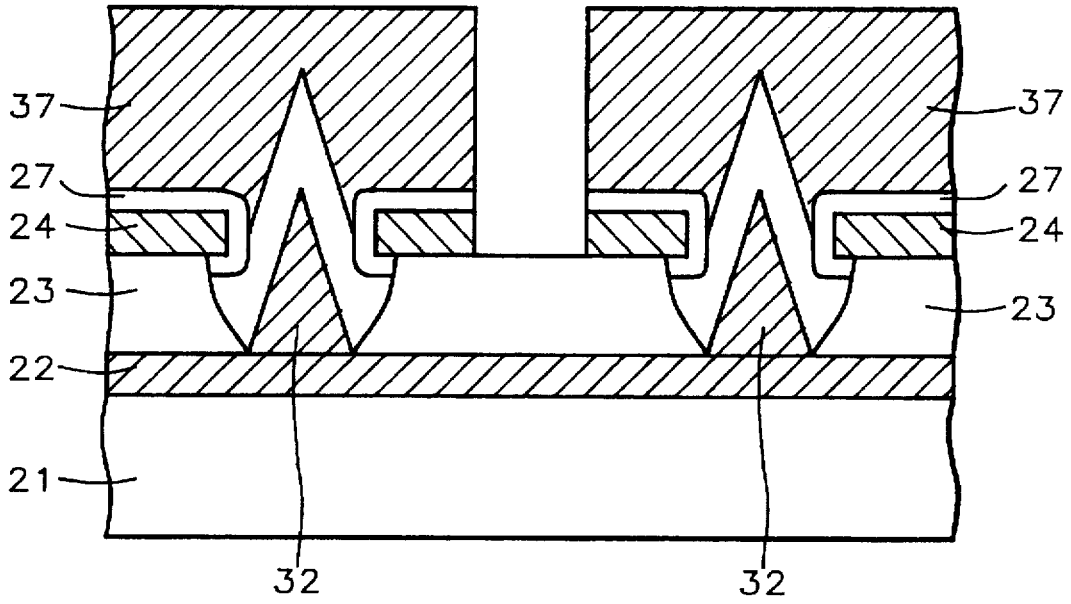

The next step, illustrated in FIG. 5, was to form the gate lines by masking and etching layers 37, 27, and 24 down to the level of insulating layer 23.

Figure 6:
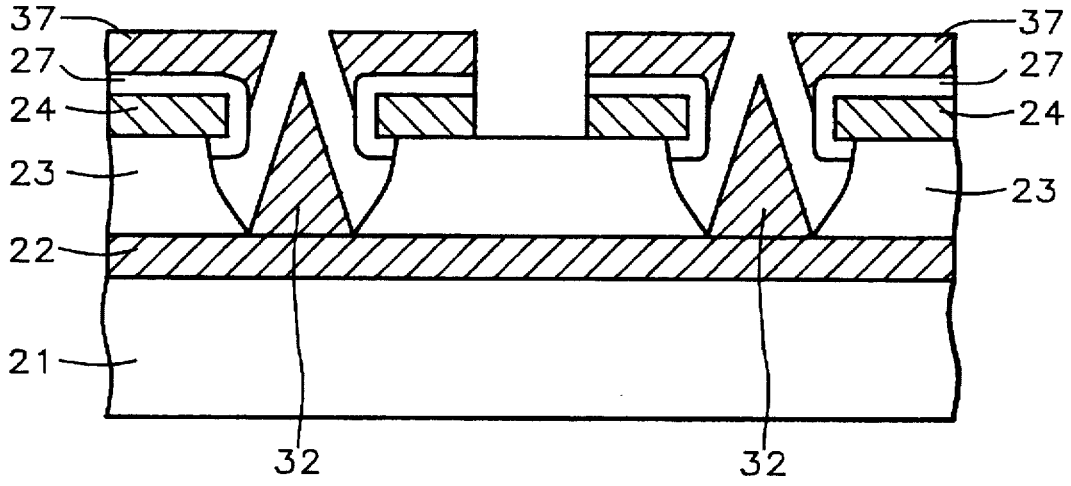
Figure 7:
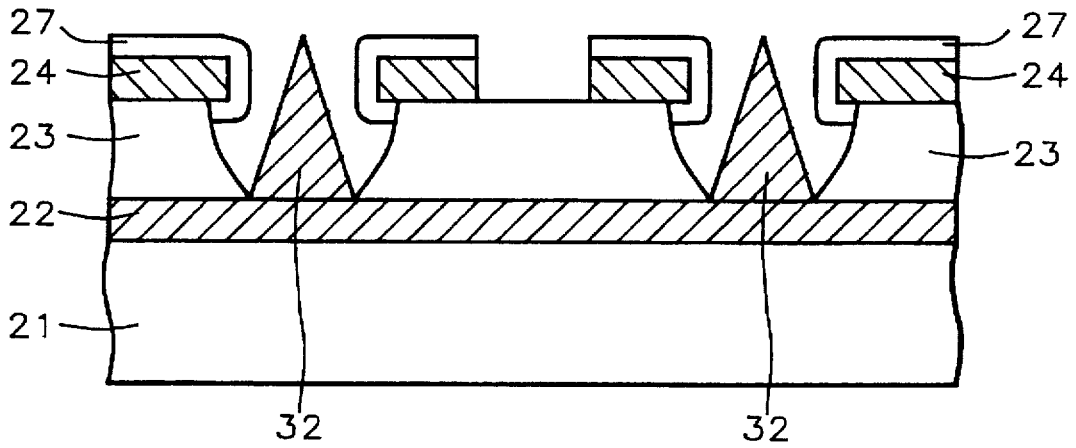

Referring to FIG. 6, chem.-mech. polishing was used to remove material from layer 37, in a plane parallel to the substrate surface. Polishing was allowed to proceed until most of layer 37 had been removed, the amount of 37 remaining being between about 0.2 and 0.5 microns in thickness. As an optional variation of this embodiment, the polishing was allowed to proceed until layer 37 had been removed in its entirety, giving the structure the appearance shown in FIG. 7.

Figure 8:
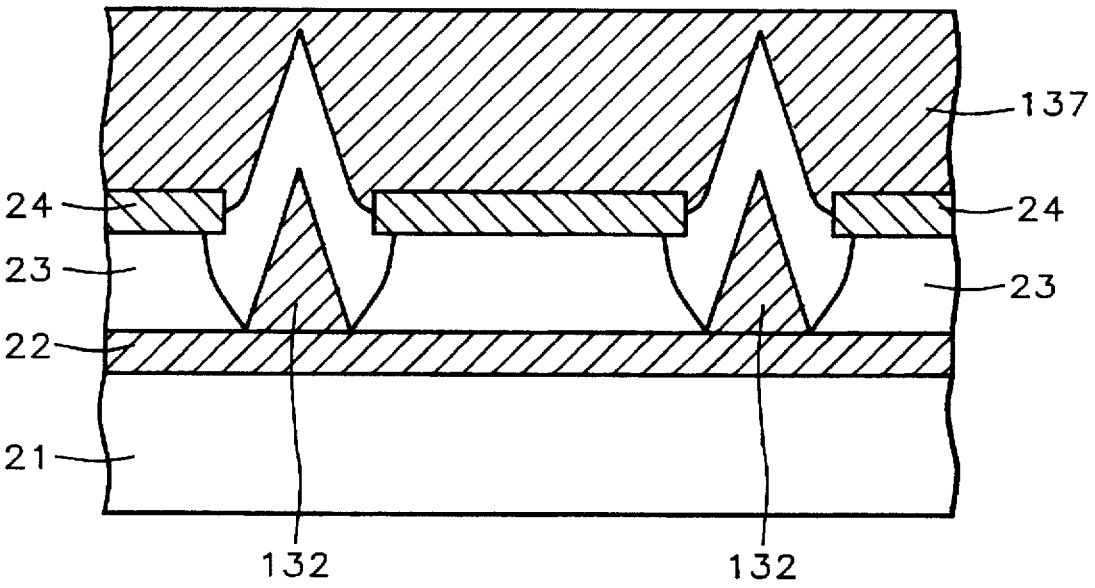
FIGS. 8 through 11 illustrate successive stages in the execution of the method that comprises a second embodiment of the present invention in which openings are etched into an insulating layer, microtips and gate lines are formed, the surface is chemically-mechanically polished to a desired thickness, and a layer is deposited to reduce the diameters of the openings.

We start the description of a second embodiment of the invention by again referring to FIG. 2 as starting point, then moving on to FIG. 8. The structure shown there was formed as follows. Under vacuum, a stream of evaporated material, such as molybdenum or tantalum, was directed at the structure at an oblique angle of incidence while at the same time rotating the structure about an axis normal to its surface. The result of this procedure was that small cones 132 formed inside openings 26 in addition to the build-up of layer 137 on the top surface of the structure. Evaporation was terminated when the original shadowing effects of openings 26 ceased to play a role, layer 137 became continuous, and the cones in openings 26 were complete. At this point the thickness of layer 137 was between 1.5 and 2 microns, as was the height of cones 132. The deposition conditions for this step were chosen so that the apexes of cones 132 were level with upper surface of layer 24.

Figure 9:
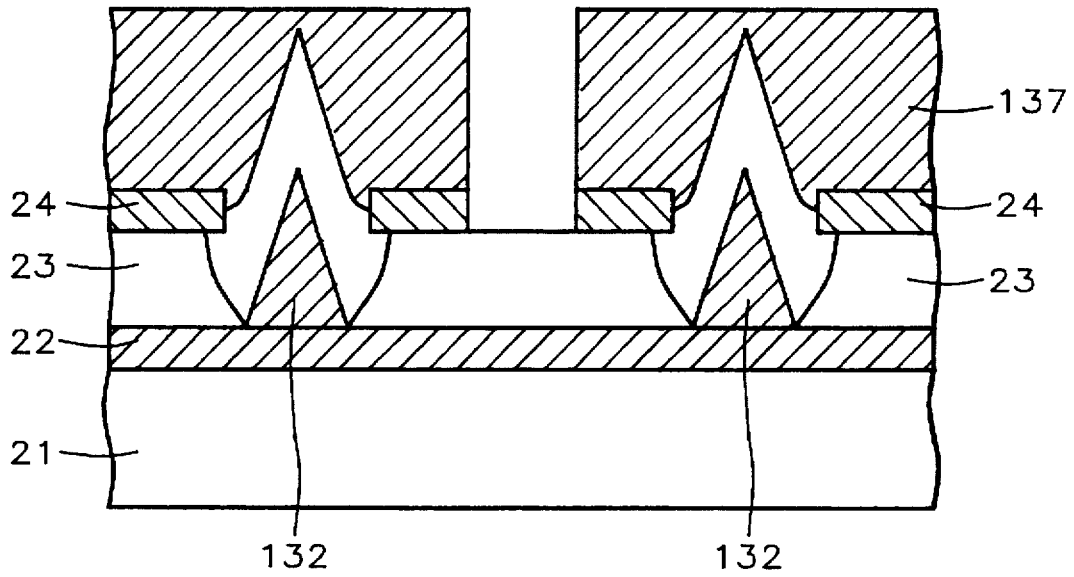

The next step, illustrated in FIG. 9, was to form the gate lines by masking and etching layers 137, and 24 down to the level of insulating layer 23.

Figure 10:
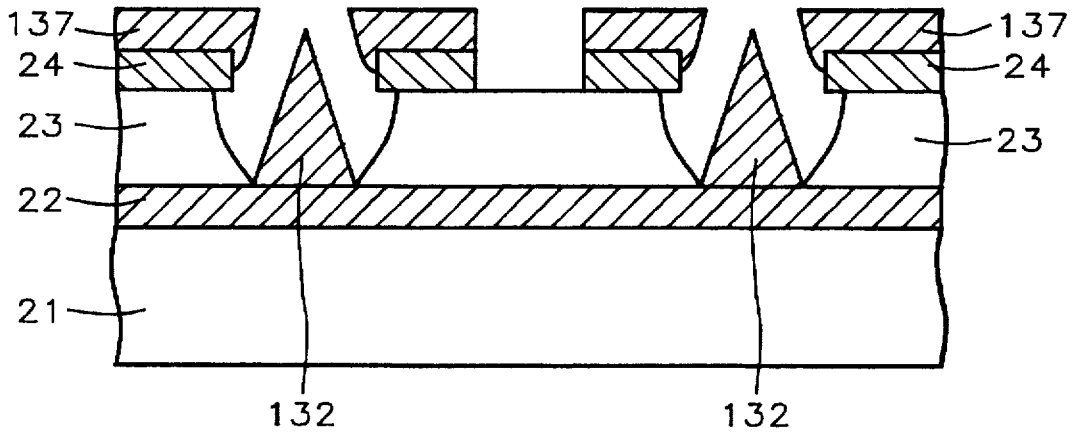
Figure 11:
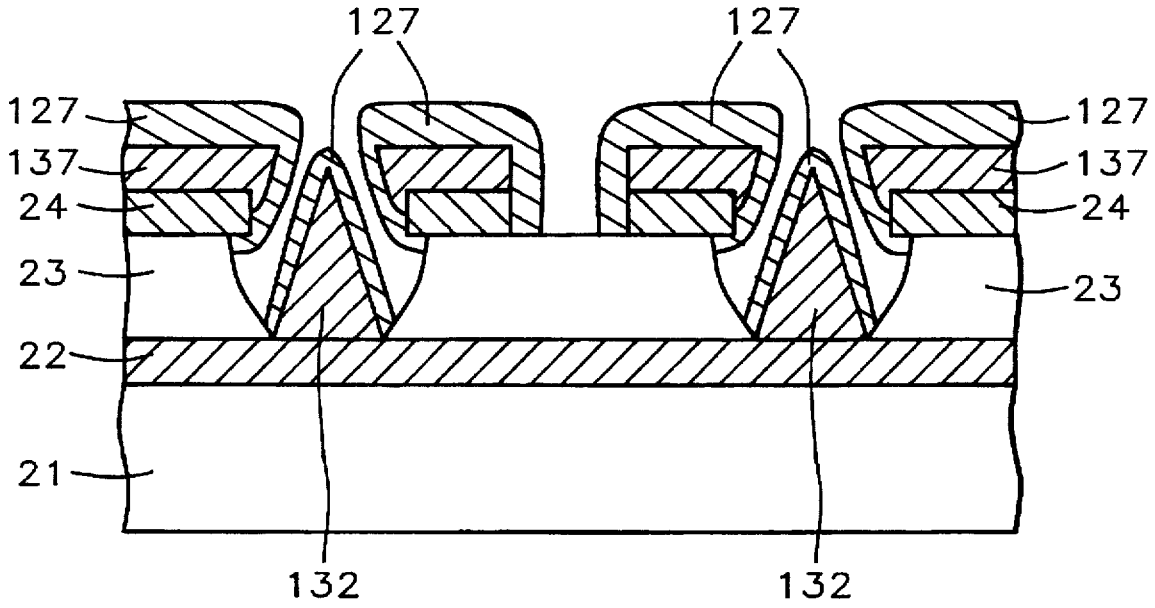

Referring to FIG. 10, the next step in the process was to use chem.-mech. polishing to remove material from layer 137, in a plane parallel to the substrate surface. Polishing was allowed to proceed until most of layer 137 had been removed, the amount of 137 remaining being between about 0.2 and 0.5 microns in thickness. An optional additional step as illustrated in FIG. 11, at this point is to further reduce the diameters of openings 26 by isotropically depositing an additional conductive layer 127 over all exposed surfaces of layers 24 and the remainder of layer 137. The preferred method for achieving this has been electroplating but other methods, such as evaporation could also be used. Typically, the additional layer has comprised silicon, molybdenum, or aluminum to a thickness between about 0.3 and 1 micron, 0.5 microns being typical. This resulted in a reduction of the diameters of openings 26 from about 2 microns to about 1 micron.

While the invention has been particularly shown and described with reference to the above preferred embodiments, it will be understood by those skilled in the art that various changes in form and details may be made without departing from the spirit and scope of the invention.

What is claimed is:

1. A method for manufacturing a cold cathode array comprising the sequential steps of:

providing an insulating substrate having an upper surface;

forming cathode columns on the upper surface of said substrate;

depositing an insulating layer on said upper surface and on said cathode columns;

depositing a first conductive layer, having an upper surface, on said insulating layer;

patterning and then etching said first conductive layer so as to form openings therein, said openings being evenly spaced above said cathode columns, down to the level of said insulating layer;

etching said insulating layer, down to the level of the cathode columns, using said first conductive layer as a mask, and then overetching so that openings etched in the insulating layer have a greater diameter than the openings etched in the first conductive layer;

depositing a second conductive layer, material for said second conductive layer being directed at said substrate at an oblique angle of incidence while said substrate is rotating about an axis perpendicular to said upper surface, thereby forming cone-shaped microtips having apexes, inside said openings in the insulating layer, until said apexes are at the level of the upper surface of said first conductive layer;

patterning, and then etching, said second and first conductive layers, down to the level of said insulating layer, to form gate lines;

removing material from said second conductive layer, in a plane parallel to said upper surface of said substrate, until said openings are clear of material from said second conductive layer; and isotropically coating all exposed portions of said first and second conductive layers with a third conductive layer, between about 0.3 microns and about 1 micron thick, thereby reducing the diameters of said openings.

2. The method of claim 1 wherein said insulating layer comprises silicon oxide.

3. The method of claim 1 wherein the thickness of said insulating layer is between about 5,000 Angstrom units and about 10,000 Angstrom units.

4. The method of claim 1 wherein said first conductive layer comprises silicon or molybdenum.

5. The method of claim 1 wherein the thickness of said first conductive layer is between about 3,000 Angstrom units and about 5,000 Angstrom units.

6. The method of claim 1 wherein said second conductive layer comprises silicon or molybdenum or tungsten or tantalum.

7. The method of claim 1 wherein the thickness of said second conductive layer is between about 3,000 Angstrom units and about 5,000 Angstrom units.

8. The method of claim 1 wherein the method for depositing said third conductive layer comprises electroplating or vacuum evaporation at grazing incidence.

9. The method of claim 1 wherein said third conductive layer comprises silicon or molybdenum or aluminum.

* * * * *